US005099722A

United States Patent [19]

Lee

[11] Patent Number: 5,099,722

[45] Date of Patent: Mar. 31, 1992

[54] CABINET SCRAPER BURNISHING TOOL

[75] Inventor: Robin C. Lee, Ottawa, Canada

[73] Assignee: Lee Valley Tools Ltd., Canada

[21] Appl. No.: 657,430

[22] Filed: Feb. 19, 1991

[51] Int. Cl.[5] ..... B21K 5/12

[52] U.S. Cl. ..... 76/89.2; 76/88

[58] Field of Search ..... 76/89.2, 88, 83; 51/214

[56] References Cited

U.S. PATENT DOCUMENTS

| | | | |
|---|---|---|---|
| 102,994 | 5/1870 | Webster | 76/89.2 |
| 441,758 | 12/1890 | Gowdy | 76/89.2 |
| 2,499,331 | 2/1950 | Robitaille | 76/89.2 |
| 4,498,360 | 2/1985 | Milum | 76/83 |
| 4,934,110 | 6/1990 | Juranitch | 76/88 |

FOREIGN PATENT DOCUMENTS

| | | | |
|---|---|---|---|
| 293785 | 3/1928 | United Kingdom | 51/214 |

OTHER PUBLICATIONS

Copy of pp. 38 and 39 from the George Ott (ULMIA) catalog of Apr. 1989.

Pp. 131 and 132 from Lee Valley Tools Ltd.'s 1984 catalog.

P. 17 from Lee Valley Tools Ltd.'s 1984 catalog.

*Primary Examiner*—Roscoe V. Parker

*Attorney, Agent, or Firm*—Kilpatrick & Cody

[57] ABSTRACT

A cabinet scraper burnishing tool enabling simple foremation of a cabinet scraper "hook." The tool generally comprises a tool body having a slot through which the cabinet scraper is passed in order to accomplish hook formation and a burnishing rod fixed in a knob and rotatably positioned partially within the slot so that rotation of the knob makes it possible to position the burnishing rod to contact the cabinet scraper edge at different selected angles.

4 Claims, 1 Drawing Sheet

CABINET SCRAPER BURNISHING TOOL

BACKGROUND OF THE INVENTION

This invention relates to burnishers for cabinet scrapers for forming "hook" cutting edges on such scrapers.

Hand woodworking cutting tools have blades of two principal types, both of which have cutting edges formed by the intersection of blade surfaces at an acute angle. Generally, blades that make what is called a shearing cut have cutting edge geometry in which the imaginary plane bisecting the acute angle formed by the cutting edge tool surfaces lies entirely in or near the body of the blade. Examples of such tools include chisels, smoothing plane blades, lathe skews and gouges, and pocket knives. Other tools generally referred to as "scrapers" have a cutting edge in the form of a "hook", and the imaginary plane bisecting the angle formed by the tool surfaces at the cutting edge lies generally perpendicular to the plane within which the body of the blade lies. The principal examples of such tools are cabinet scrapers, scraping plane blades, and bowl scraper lathe turning tools.

Important among these scraping tools are cabinet scrapers, which are deceptively simple in appearance but very useful for removing extremely fine layers of wood or finish, while leaving a very smooth, level surface. The most commonly used cabinet scraper configuration is a flat rectangular sheet of spring steel on the order of 1/32nd inch thick and roughly the size of a small index card. Alternative shapes of cabinet scrapers have curved, rather than straight edges, and typically available thicknesses range between 0.015" (0.4 mm) and 0.042" (1.0 mm).

Such cabinet scrapers are prepared for use by grinding or filing and honing the edge so that it is straight (or smoothly curved in the case of curved scrapers), very smooth, and square to the scraper body. A "hook" may then be formed along the scraper edge by drawing the burnisher along the edge while it is oriented at an angle varying between approximately 90° and 75° to an imaginary line normal to the scraper edge and lying within the plane of the scraper plate. Typical burnishers are smooth, hardened steel rods having oval, round, rectangular, square or triangular cross sections and a handle. While burnishers intended solely for use with cabinet scrapers are widely available, the backs of woodworking chisels are also usable, as are other suitably shaped rods provided, in each case, that the hardness of the burnisher is greater than that of the cabinet scraper.

The typical technique for forming a hook on a cabinet scraper with a burnisher involves mounting the cabinet scraper in a vise and drawing the burnisher across the scraper's edge while holding both ends of the burnisher with it oriented during sequential passes at angles decreasing from approximately 90° to no less than approximately 75°.

The principal drawback associated with this hook-forming method is the difficulty of accurately and reproducibly selecting and maintaining the angle at which the burnisher is oriented. This problem is most acutely experienced by neophytes.

A wheel burnisher is also available for forming the hook with a hardened steel wheel, but the angle of contact between the burnishing wheel in such devices and the scraper edge cannot be varied.

There is, accordingly, a need for a burnishing apparatus sufficiently simple to be competitive in cost with conventional burnishers but able to maintain a selected relative angular position between the burnisher and scraper blade.

SUMMARY OF THE INVENTION

The present invention is a burnishing tool for forming the hook on a cabinet scraper with a burnishing rod or dowel that is maintained at a predetermined, controlled angle relative to the plane within which the cabinet scraper lies.

The burnishing apparatus of the present invention generally includes a burnisher body containing a slot through which the cabinet scraper is passed during burnishing. A burnishing rod positioning knob is journaled in a hole in the body oriented on an axis normal to the plane of the slot. A round burnishing rod is fixed in the knob so that the axis of the rod forms a desired maximum angle, such as approximately 15°, with the axis of the knob, and the rod and knob is positioned so that the intersection of the knob and burnishing rod axes falls within the plane of the slot.

A set screw positioned within the tool body bears against a circumferential groove in the knob, thereby capturing the knob within the body and making it possible to lock it in desired positions. The knob carries a skirt that lies against the burnisher body, and the skirt or adjacent body is marked about 180° of the knob's circumference with degree markings varying between the maximum angles right and left, e.g. 15°-0°-15 °. Such markings are read by reference to an index marking on the knob or on the face of the body.

The burnishing apparatus is utilized by locking the positioning knob at a desired angle and then moving the cabinet scraper and apparatus relative to each other with the scraper positioned in the slot so that its edge bears against the burnishing rod.

DETAILED DESCRIPTION OF THE DRAWINGS

Figure 1:
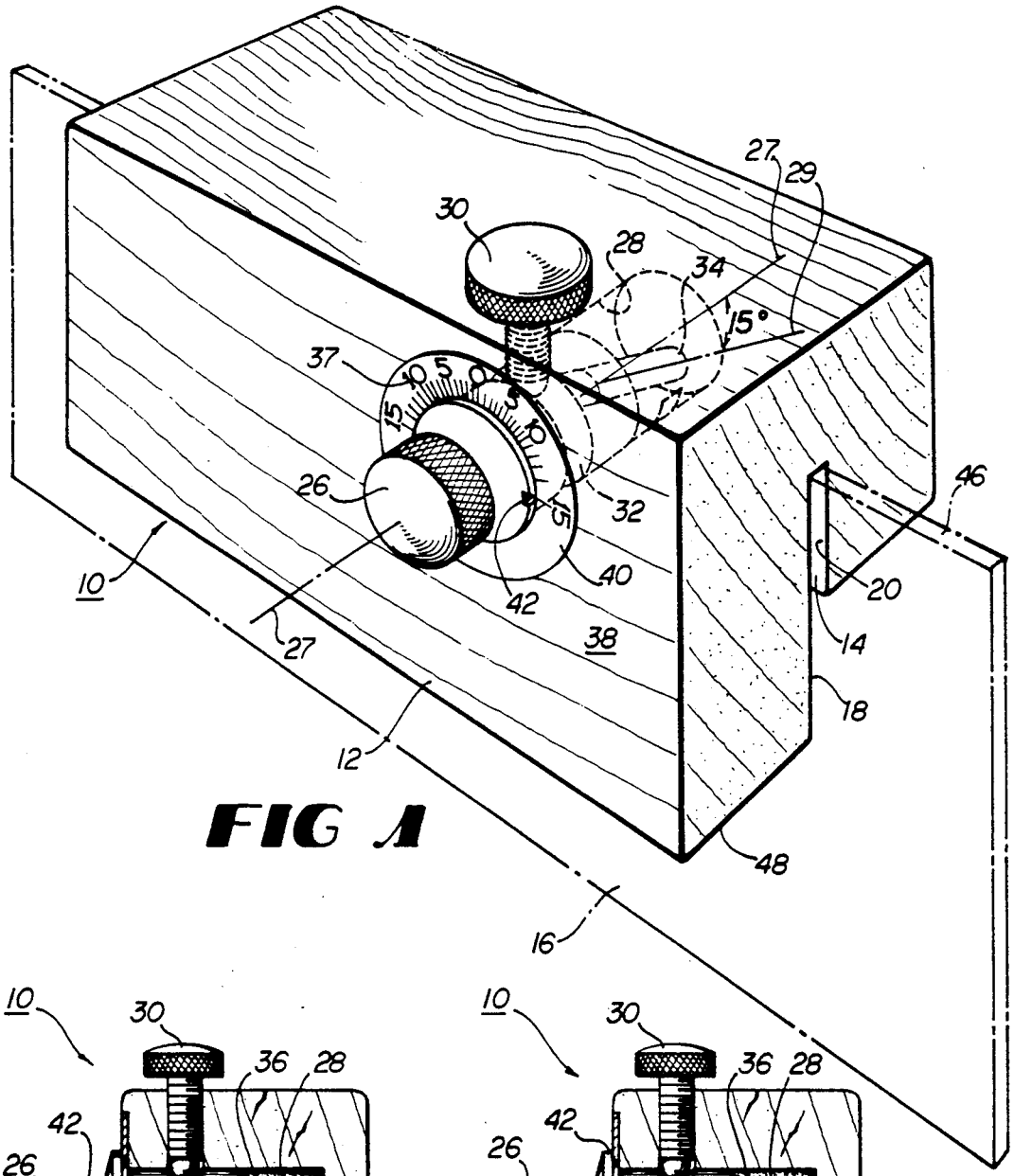
FIG. 1 is a perspective view of the cabinet scraper burnishing tool of the present invention with a typical cabinet scraper shown in broken lines in position within the tool.
Figure 2:
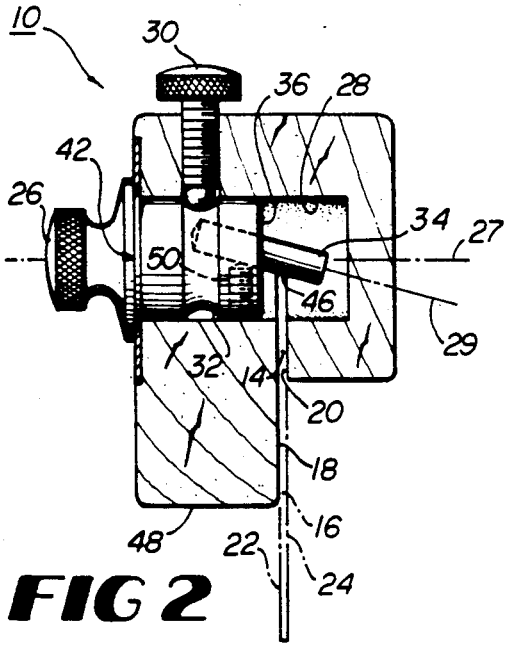
FIG. 2 is a side elevation view of the tool and scraper of FIG. 1 with the scraper-contacting surface of the burnishing rod shown at its steepest angle and a portion of the tool body cut away to make visible the entire knob, set screw and burnishing rod.
Figure 3:
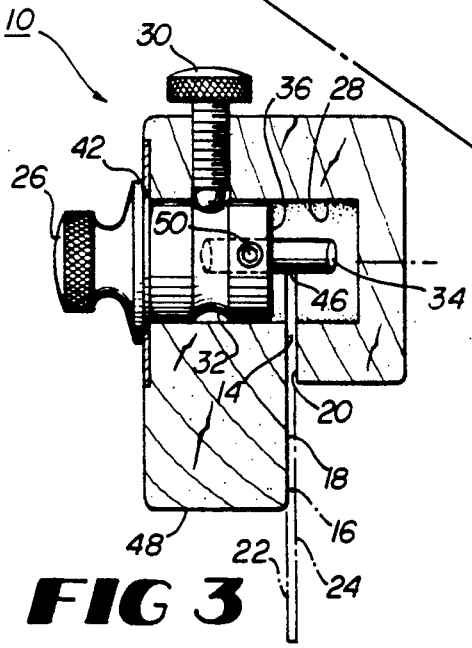
FIG. 3 is a side elevation view similar to FIG. 2 with the scraper-contacting surface of the burnishing rod shown positioned at a right angle to the cabinet scraper.

Referring to FIGS. 1, 2 and 3, burnishing tool 10 includes a tool body 12 which may be a block of hardwood, plastic or other suitable material such as aluminum or composites, provided that the material generally should not be harder than. the typical scraper 16 and should have smooth, non-abrasive surfaces. While tropical hardwoods would typically be very handsome and highly functional, particularly if they are oily and therefore self-lubricating like lignum vitae or rosewood, the limited availability of such woods and ecological concerns associated with their use makes selection of such materials for body 12 questionable. Accordingly, a wide variety of hardwoods native to North America will typically be preferable, including, for instance, maple, cherry, walnut, beech, popular, boxwood and mesquite. Most softwoods including, for instance, sugar pine, are less desirable.

The particular dimensions and geometry of body 12 are generally not critical, provided that it be machined to include a slot 14 of sufficient width to accommodate typical cabinet scrapers 16 with a "sliding fit". Slot 14 should be sufficiently deep to easily maintain cabinet scraper 16 within it without undue wobbling, while an adequate portion of a typical cabinet scraper 16 will protrude from the slot 14 to enable the scraper 16 to be easily grasped. Body 12 illustrated in the figures has a slot 14 defined by a taller side 18 and a shorter side 20, making it convenient for a user to clamp scraper 16 in a vise with the taller side 18 of body 12 manually pressed against the scraper face 22 providing a greater bearing surface thus improving alignment of scraper 16 with respect to rod 34.

Knob 26 is journaled in a hole 28 in body 12 having an axis 27 normal to the plane slot 14 and near the bottom of slot 4. A knurled set screw 30 threaded into body 12 bears against a groove 32 in knob 26, thereby capturing knob 26 and making it possible to fix knob 26 in a desired position so that it will not rotate within hole 28.

A round burnishing rod or dowel 34 is fixed in the end 6 of knob 26 within body 12 by setscrew 50 so that the axis 29 of rod 34 intersects and forms an acute angle with the axis of knob 26 and intersects such axis in substantially the middle of groove 32. Burnishing rod 34 should be positioned within body 12 so that at least a small portion of it lies above the bottom of groove 32 regardless of the orientation of knob 26 and burnishing rod 34. Burnishing rod 34 should be hardened steel, tungsten-carbide or other suitable material that is harder than typical cabinet scrapers, which range in hardness from approximately Rc38 to Rc52. As burnishing rod 34 wears, it can be rotated, turned end for end, or replaced as necessary by loosening setscrew 50.

Appropriate markings 37 on the face 38 of body 12 and knob 26 indicate the angular position and orientation of burnishing rod 34 relative to slot 14. For instance, a skirt 40 on knob 26 can be marked around 180° of its circumference to indicate angular position of the burnishing rod 34 varying between the maximum angle in one orientation through 0 to the maximum opposite orientation. While the "left" or "right" sloping orientation of burnishing rod 34 relative to slot 14 can be visually confirmed within the slot, it can be more easily determined from a sloping position-indicating marking 42 located, for instance, on the peripheral edge of skirt 40 and visible in FIG. 2.

Alternative marking arrangements can be easily used, such as degree markings on knob 26 and a position indicator on body 12. Such markings may be embossed, engraved, silk screened, carved, printed, etched, inlaid or otherwise suitably applied to knob 26 and face 38.

As will be readily understood by one skilled in the art, burnishing tool 10 is utilized simply by rotating knob 26 until burnishing rod 34 is positioned at a desired angle and knob 26 is locked in position with set screw 30. Then cabinet scraper 16 and burnishing tool 10 are moved relative to each other with cabinet scraper 16 positioned within groove 32 so that the edge 46 of cabinet scraper 16 bears against burnishing rod 34. Among other possible means for holding burnishing tool 10 and cabinet scraper 16, it may be found desirable to position cabinet scraper 16 within the padded jaws of a vise with cabinet scraper 16 protruding such that the bottom face 48 of body 12 does not contact the top surface of the vise jaws while the cabinet scraper edge 46 makes contact with burnishing rod 34. The burnishing tool is then moved over the scraper edge under firm hand pressure. While positioning burnishing rod 34 within knob 26 at an angle of 15° relative to the knob 26 axis will permit burnishing at all commonly desired angles, it should be understood that burnishing rod 34 may be fixed at other greater or lesser angles.

The foregoing description of this invention is for purposes of explanation and illustration. It will be apparent to those skilled in the art that modification and changes may be made to this invention as thus described without departing from its scope and spirit.

I claim:

1. A scraper burnishing tool comprising a means for holding a scraper blade having an edge at a predetermined angle between approximately 90° and 75° relative to a fixed burnishing surface while the surface is passed over the edge and a means for selectively varying the predetermined angle.

2. A cabinet scraper burnishing tool, comprising a tool body having a slot to receive a scraper, a burnishing rod positioned within the tool body and at least partially within the slot and a means for selectively positioning the burnishing rod within the tool body at more than one fixed angle between the slot and the surface of the rod.

3. A cabinet scraper burnishing tool, comprising a tool body having a slot to receive a scraper, a burnishing rod positioned within the tool body and at least partially within the slot and a means for selectively positioning the burnishing rod within the tool body to make it possible to select more than one desired angle between the slot and the surface of the rod comprising, a knob rotatably positioned within the tool body and carrying the burnishing rod so that rotation of the knob varies the angle between the burnishing rod surface and the slot.

4. A cabinet scraper burnishing tool, comprising a tool body containing a slot for receiving a scraper blade, a knob journaled within the tool body, and a burnishing rod fixed in the knob at an angle to the knob axis and positioned so that a portion of the rod surface lies within the slot and rotation of the knob varies the relative angle between the rod surface and the slot.

* * * * *

UNITED STATES PATENT AND TRADEMARK OFFICE

CERTIFICATE OF CORRECTION

PATENT NO. : 5,099,722

DATED : March 31, 1992

INVENTOR(S) : Robin C. Lee

It is certified that error appears in the above-identified patent and that said Letters Patent is hereby corrected as shown below:

Abstract, lines 2 - 3, delete "foremation" and insert --formation--
Column 3, line 26, delete "6" and insert --36--

Signed and Sealed this

First Day of June, 1993

*Attest:*

Michael K. Kirk

MICHAEL K. KIRK

*Attesting Officer*

*Acting Commissioner of Patents and Trademarks*